United States Patent [19]

Butterwick

[11] Patent Number: 4,585,935

[45] Date of Patent: Apr. 29, 1986

[54] ELECTRON DISCHARGE DEVICE HAVING A SUBSTANTIALLY SPHERICAL ELECTROSTATIC FIELD LENS

[75] Inventor: Gilbert N. Butterwick, Leola, Pa.

[73] Assignee: RCA Corporation, Princeton, N.J.

[21] Appl. No.: 579,188

[22] Filed: Feb. 10, 1984

[51] Int. Cl.[4] ..... H01J 31/50

[52] U.S. Cl. ..... 250/213 VT; 313/103 CM; 313/540; 313/250

[58] Field of Search ..... 250/213 VT; 313/540, 313/250, 251, 268, 299, 300, 103 R, 103 CM, 104, 105 R, 105 CM

[56] References Cited

U.S. PATENT DOCUMENTS

| | | | |
|---|---|---|---|
| 2,131,185 | 9/1938 | Knoll | 250/27.5 |
| 2,189,319 | 2/1940 | Morton | 250/153 |
| 2,487,665 | 11/1949 | Morton et al. | 250/165 |
| 2,666,864 | 1/1954 | Longini | 313/65 |
| 3,290,171 | 12/1966 | Zollman et al. | 117/160 |
| 3,502,928 | 3/1970 | Guyot et al. | 313/82 |
| 3,658,400 | 4/1972 | Helvy | 313/94 |
| 3,735,139 | 5/1973 | Kalitinsky et al. | 250/213 VT |
| 3,936,687 | 2/1976 | Schagen et al. | 250/213 VT |
| 4,021,693 | 5/1977 | Bradley et al. | 313/99 |
| 4,355,229 | 10/1982 | Zimmerman et al. | 250/213 VT |

FOREIGN PATENT DOCUMENTS 456728 11/1936 United Kingdom .

OTHER PUBLICATIONS

Patent Abstract 488,416, by Zietline et al., Dec. 3, 1936.

Patent Abstract DE 2852-972-C from Derwent Publications, Nov. 2, 1983, p. 28.

SIT/CCD Camera Tube C21205 Data Sheet, published by RCA, Lancaster, PA 17604.

*Primary Examiner*—David C. Nelms

*Assistant Examiner*—J. Gatto

*Attorney, Agent, or Firm*—Eugene M. Whitacre; Dennis H. Irlbeck; Vincent J. Coughlin, Jr.

[57] ABSTRACT

An electron discharge device of the type including an evacuated envelope having a longitudinal axis comprises a photoemissive cathode for providing electrons in response to radiation incident thereon and a charge coupled device spaced from the cathode. A plurality of washer-like focusing electrodes are disposed between the cathode and the charge coupled device for focusing electrons therebetween. Each of the electrodes has an electron aperture of progressively decreasing diameter. The electron aperture of the electrode adjacent to the cathode is larger than the electron aperture in the electrode adjacent to the charge coupled device. The electrodes provide a substantially spherical electrostatic field lens between the photoemissive cathode and the charge coupled device.

5 Claims, 2 Drawing Figures

ELECTRON DISCHARGE DEVICE HAVING A SUBSTANTIALLY SPHERICAL ELECTROSTATIC FIELD LENS

The invention relates to an electron discharge device and more particularly to an intensified charge coupled image sensor having a high demagnification and comprising a plurality of field forming electrodes which form a substantially spherical electrostatic field lens for focusing electrons from a photoemissive cathode to a charged coupled device which provides an electrical output.

U.S. Pat. No. 2,666,864, issued to Longini on Jan. 19, 1954, discloses a conventional electrostatically focused, demagnifying-type, image intensifier tube having a plurality of substantially cylindrical focusing electrodes disposed between a photoemissive cathode located at the input end of the tube and a fluorescent screen at the output end of the tube. A cylindrical focusing electrode is defined as any drawn or formed electrode having a significant longitudinal dimension along the electron path, relative to the length of the tube, such that when a potential is applied to the focusing electrode, the equipotential contour lines near the focusing electrode experience high curvature of field. The high field curvature causes a loss of edge resolution and pin cushion distortion of the electron image.

U.S. Pat. No. 4,355,229, issued to Zimmerman et al. on Oct. 19, 1982, discloses an intensified charge coupled image sensor of substantially unity magnification having substantially cylindrical focusing elements which introduce pin cushion distortion in the image plane of the device. The Zimmerman et al. patent is incorporated herein for the purpose of disclosure.

SUMMARY OF THE INVENTION

An electron discharge device of the type including an evacuated envelope having a longitudinal axis comprises a photoemissive cathode for providing electrons in response to radiation incident thereon and output means spaced from the cathode. The electron discharge device further comprises focusing means disposed between the cathode and the output means for focusing electrons therebetween. The focusing means include a plurality of discrete, washer-like electrodes each having an electron aperture of progressively decreasing diameter wherein the electron aperture in the electrode adjacent to the cathode is larger than the electron aperture in the electrode adjacent to the output means. The electrodes provide a substantially spherical electrostatic field lens between said photoemissive cathode and said output means.

DETAILED DESCRIPTION OF THE PREFERRED EMBODIMENTS

Figure 1:
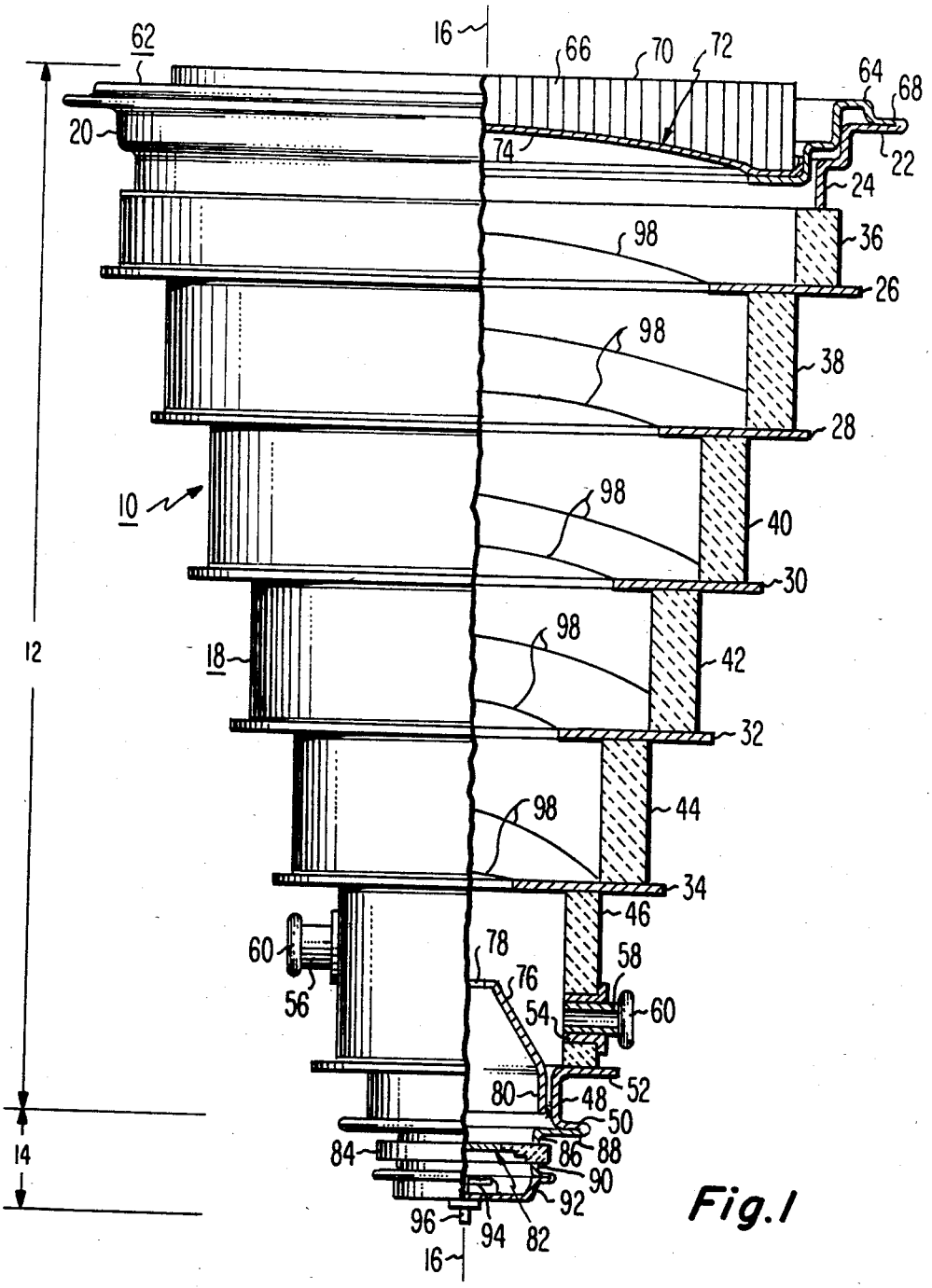
FIG. 1 is an elevational view, partially in axial section, of an intensified charge coupled image sensor in which the present invention is incorporated.

An intensified charge coupled image sensor 10 is shown in FIG. 1. The image sensor 10 comprises an inverter image intensifier section, generally indicated as

12, and a header assembly, generally designated as 14. An optical axis, 16, extends longitudinally along the center line of the sensor 10.

The novel image intensifier section 12 comprises a vacuum envelope 18 which may be of glass-metal or ceramic-metal construction. For maintaining close dimensional tolerances, ceramic-metal construction is preferred. The intensifier section 12 includes a conductive annular cathode bulb flange 20 having a substantially flat radially extending cathode weld lip 22 and a bulb portion 24. Spaced from the bulb flange 20 are a plurality of substantially flat, annular field forming electrodes 26, 28, 30, 32 and 34. In the present design, five field forming electrodes are utilized; however, a greater or lesser number may be used. Disposed in vacuum-tight relation between the bulb flange 20 and each of the field forming electrodes 26, 28, 30, 32 and 34 are a plurality of substantially cylindrical insulative support members 36, 38, 40, 42 and 44. An anode insulative support member 46 is disposed in vacuum-tight relation between the fifth field forming electrode 34 and an anode bulb flange 48 which is of generally U-shaped cross-section. The anode bulb flange 48 has a substantially flat radially extending anode weld lip 50 and a substantially flat radially extending sealing surface 52. Preferably, the insulative support members 36, 38, 40, 42, 44 and 46 comprise a high alumina ceramic, as is known in the art. The bulb flanges 20 and 48 and the field forming electrodes 26, 28, 30, 32 and 34 are preferably made of KOVAR. The brazing of ceramics to metal is described in U.S. Pat. No. 3,290,171, issued to Zollman et al. on Dec. 6, 1966, which is incorporated herein for the purpose of disclosure.

A plurality of access apertures, 54, only one of which is shown, extend through the body of the anode insulative support member 46. The purpose of the access apertures will be discussed hereinafter. The vacuum integrity of the envelope 18 is maintained by brazing a plurality of copper tubulations 56 and 58 into the support member 46 surrounding the apertures 54. The tubulations 56 and 58 are shown as being "tipped-off", i.e., cold welded by crimping. A tip-off protector 60 is attached to the end of each of the "tipped-off" tubulations 56 and 58 to protect the tubulations from damage.

A cathode faceplate assembly 62 seals one end of the envelope 18. The cathode faceplate assembly 62 includes a cathode faceplate flange 64 and a cathode faceplate 66. The faceplate 66 is sealed to the faceplate flange 64 by a method well known in the art to form a vacuum seal. The faceplate flange 64 includes a substantially flat, radially extending faceplate flange welding lip 68, which is heliarc welded to the cathode weld lip 22. The cathode faceplate, 66, which preferably comprises a vacuum-tight fiber optic, has a planar exterior surface 70 and a concave interior surface 72. An alkali-antimonide photoemissive cathode 74 is formed on the interior surface 72 of the faceplate 66.

An anode cone 76, having a centrally located anode aperture 78, is spaced from the fifth field forming electrode 34 and disposed within the anode insulative support member 46. The anode cone 76 has a proximal end 80, which is fixedly attached, for example, by welding or brazing, to the longitudinally extending inner surface of the anode bulb flange 48.

The header assembly 14 includes a silicon charge coupled device (CCD) 82, which is located in the focal plane, i.e., a plane substantially orthogonal to the optical axis 16 of the image sensor 10, where the photoelectrons from the photoemissive cathode 74 are focused. The CCD 82 may include a support structure (not shown), such as that described in U.S. patent application, Ser. No. 494,288, filed on May 13, 1983, by Zollman et al. and incorporated by reference herein for the purpose of disclosure. The header assembly 14 also includes a ceramic header member 84, which provides electrical contact to the CCD 82. The header member 84 is vacuum-sealed at one end to a header bulb flange 86 having a substantially flat, radially extending header weld lip 88, and at the other end to a getter flange 90. A getter cup 92, having a porous getter 94 therein, such as that manufactured by SAES, Milan, Italy, is sealed to the getter flange 90. An electrically insulated feedthrough 96 extends in a vacuum-tight fashion through the getter cup 92 to support one end of the getter 94. The other end of the getter 94 is secured to the inside surface of the getter cup 92.

Unlike a conventional electrostatically focused, demagnifying type image intensifier tube, which utilizes a plurality of substantially cylindrical focusing electrodes to form a cylindrical lens to transfer an electron image from the photoemissive cathode to the focal plane of the tube, the novel image intensifier section 12 comprises a plurality of discrete, coaxially aligned, washer-like annular field forming electrodes having a longitudinal dimension that is small compared to the length of the sensor 10, thereby forming a spherical lens between the photoemissive cathode 74 and the charge coupled device 82 which is located at the focal plane of the sensor. Each of the field forming electrodes 26, 28, 30, 32 and 34 has a thickness of about 0.76 mm (0.03 inches). The overall length of the sensor 10 is about 190.5 mm (7.5 inches).

The approximate inner and outer diameter of the field forming electrodes 26, 28, 30, 32 and 34 are provided in TABLE I. TABLE II provides the approximate height as well as the inner and outer diameters of the insulative support members 36, 38, 40, 42 and 44.

TABLE I

| FIELD FORMING ELECTRODE | I.D. (mm) | O.D. (mm) |
|---|---|---|
| 26 | 76 | 127 |
| 28 | 61 | 112 |
| 30 | 46 | 97 |
| 32 | 30 | 81 |
| 34 | 15 | 66 |

TABLE II

| INSULATIVE SUPPORT MEMBERS | I.D. (mm) | O.D. (mm) | Height (mm) |
|---|---|---|---|
| 36 | 107 | 122 | 13 |
| 38 | 91 | 107 | 23 |
| 40 | 76 | 91 | 24 |
| 42 | 61 | 76 | 24 |
| 44 | 46 | 61 | 24 |

The anode insulative support member 46 has a height of about 30 mm, an inside diameter of about 36 mm and an outside diameter of about 46 mm.

It can be seen from TABLES I and II and from FIG. 1 that the inside diameter of the first field forming electrode 26 is less than the inside diameter of the first insulative support member 36. This is also true for each of the subsequent field forming electrodes and the corresponding insulative support members, including the fifth field forming electrode 34 and the fifth insulative support member 44. This structural aspect of the intensifier section 12 is important, because the field forming electrodes 26, 28, 30, 32 and 34 also provide shielding during the formation of the alkali-antimonide photoemissive cathode 74 on the interior surface 72 of the faceplate 66. The formation of alkali-antimonide photoemissive cathodes is well known in the art and is described, for example, in U.S. Pat. No. 3,658,400, issued to F. A. Helvy on Apr. 25, 1972, and incorporated herein for disclosure purposes. Briefly, the process includes positioning an antimony source, not shown, at a distance from the interior surface 72 of the faceplate 66 and evaporating antimony from the source onto the interior surface 72 of the faceplate 66. Preferably, the antimony source is located at about the center of curvature of the faceplate 66. The antimony source is introduced into the sensor 10 through the untipped-off tubulation 56. The antimony is supported in a retractable assembly which restricts the evaporation upward toward the faceplate 66. However, unless adequate precaution is taken, the antimony will be deposited also along the interior surface of the insulative support members 36, 38, 40, 42 and 44, thereby rendering the insulators conductive. The inwardly directed field forming electrodes 26, 28, 30, 32 and 34 intercept a portion of the antimony that would otherwise be deposited on the insulative members without interfering with the antimony deposition on the interior surface 72 of the faceplate 66. Subsequent to the antimony deposition described herein, suitable alkali vapors are introduced into the intensifier section 12 through the untipped-off tubulation 58 to react with the antimony on the interior surface 72 of the faceplate 66 to form the cathode 74. After the photoemissive cathode 74 is formed, the antimony source is withdrawn from the intensifier section 12 through the tubulation 56, and both of the tubulations 56 and 58 are "tipped-off", and the tip-off protectors 60 are attached to the ends thereof.

In order to minimize internal reflections within the intensifier section 12, it is known in the art to appropriately treat the flat interior surfaces of the field forming electrodes 26, 28, 30, 32 and 34 to prevent light from being reflected back to the photoemissive cathode 74. The surface of each of the electrodes can be roughened or provided with a dark mat finish, and/or chrome oxide may be sprayed on the electrodes.

THEORY OF OPERATION

The image intensifier section 12 is operated by applying a negative potential within the range of −10 kV to −12 kV to the photoemissive cathode 74 by means of the cathode bulb flange 20. In order to obtain a spherical electron lens, the potential, $V_n$, applied to each of the successive field forming electrodes 26, 28, 30, 32 and 34 is determined by the following relationship:

$$V_n = V_{PC}\left(\frac{r_n}{r_T}\right)^{\frac{1}{2}}; \quad (1)$$

where:

$V_{PC}$ is the photoemissive cathode potential in kilovolts, $r_n$ is the radial distance of the nth electrode from the origin, $r_T$ is the total distance from the origin to the photoemissive cathode, and $V_n$ is the potential in kilovolts on the nth field forming electrode spaced a distance, $r_n$, from the origin. In this example, the origin is a point on the optical axis 16 located within the aperture 78 of the anode cone 76. The photoemissive cathode 74 is located about 139.7 mm (5.5 inches) from the origin. The photoemissive cathode 74 provides electrons in response to radiation incident thereon.

By way of example, if the photoemissive cathode potential, $V_{PC}$, is chosen to be −10 kV, then the potential $V_1$ on the first field forming electrode 26 which is spaced a radial distance of 120.65 mm (4.75 inches) from the origin is:

$$V_1 = -10\text{ kV}\left(\frac{120.65\text{ mm}}{139.70\text{ mm}}\right)^{\frac{1}{2}}; \quad (2)$$

$$V_1 = -9.29\text{ kV}. \quad (3)$$

TABLE III lists the radial spacing of the field forming electrodes from the origin and the operating potential applied to each of the field forming electrodes for a photoemissive cathode 74, which is operated at a potential of negative 10 kV and spaced a distance of 139.70 mm (5.5 inches) from the origin. The anode cone 76 in this example is operated at ground potential. In this example, the photoemissive cathode 74 had an effective diameter of 80 mm, and the resultant electron image is focused on a CCD 82 that has a diagonal dimension of 8 mm. The image intensifier section 12 thus demagnifies the photocathode electron image by a factor of 10.

TABLE III

| FIELD FORMING ELECTRODE | | $r_n$ (mm) | $V_n$ (kV) |
|---|---|---|---|
| First | 26 | 120.65 | −9.29 kV |
| Second | 28 | 95.25 | −8.26 kV |
| Third | 30 | 69.85 | −7.07 kV |
| Fourth | 32 | 44.45 | −5.64 kV |
| Fifth | 34 | 19.05 | −3.69 kV |

The above-indicated potentials, when applied to the field forming electrodes, will produce equipotential lines 98 that are substantially spherically shaped and, therefore, essentially free of edge distortion. In a spherical lens field, the photoelectrons emitted from the photocathode 74 are accelerated and directed in a precise manner to the center of the lens where they cross-over and enter the anode aperture 78. Once within the anode cone 76, the electrostatic field is essentially constant so that the photoelectrons proceed to impinge on the surface of the CCD 82, which is disposed in the focal plane of the sensor 10. The photoelectrons from the photoemissive cathode 74, which is operated at a potential of about −10 kV, produce about 1600 electron-hole pairs for each photoelectron incident on the CCD. The high electron gain and freedom from distortion achieved by the spherical lens structure of the present invention makes the sensor 10 an ideal instrument for low light level imaging applications. The electron gain can be increased to about 2000 electron-hole pairs by increasing the photoemissive cathode potential, $V_{PC}$, to −12 kV and proportionally increasing each of the field forming electrode voltages according to Equation 1.

Figure 2:
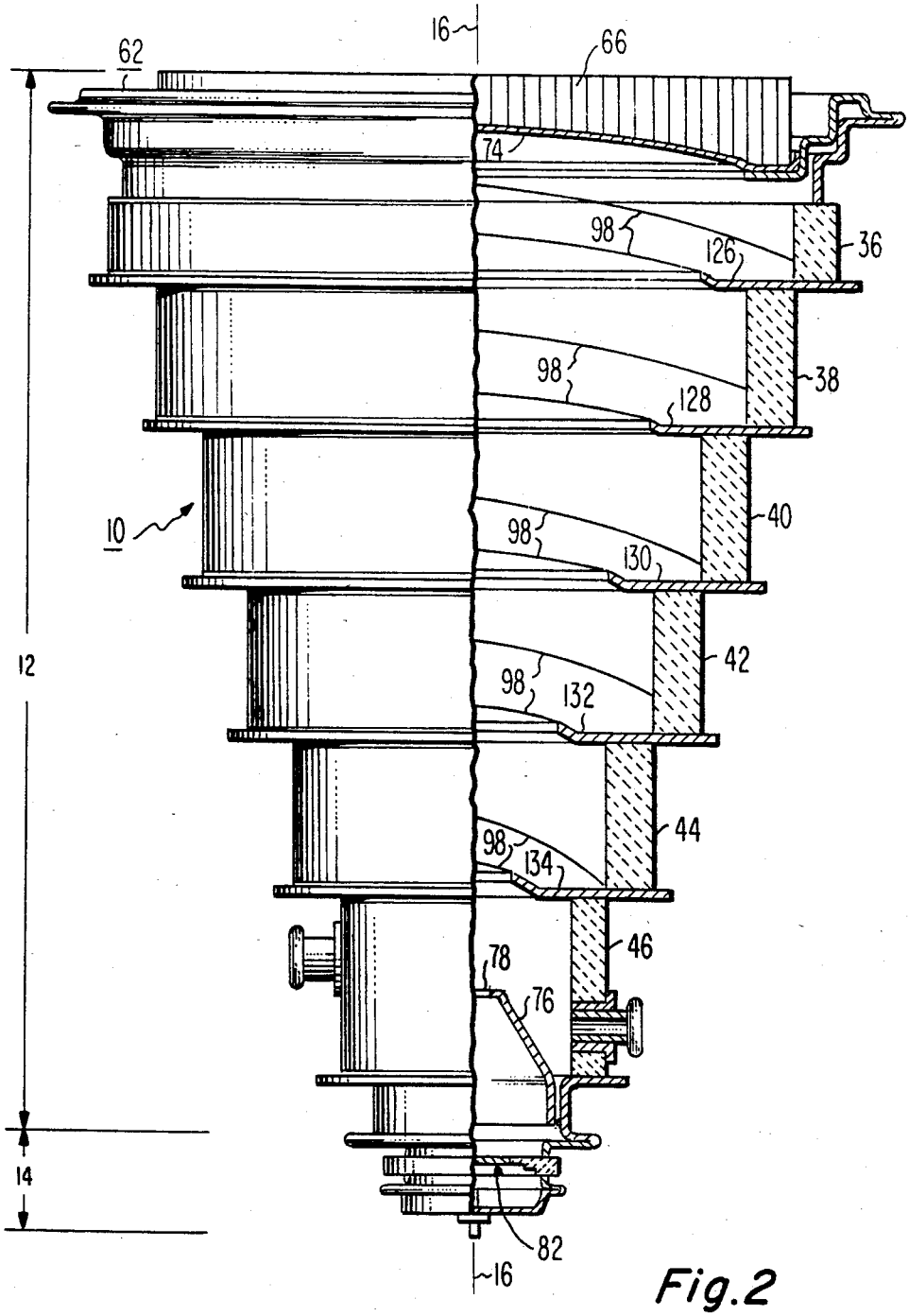
FIG. 2 is an elevational view, partially in axial section, of an intensified charge coupled image sensor in which a second embodiment of the present invention is incorporated.

A second embodiment of the present invention is shown in FIG. 2. The structure is similar to that described in FIG. 1, and in FIG. 2, like numbers are used to described like components, except that the first digit of each designation number of the field forming electrodes is varied to identify a different embodiment. The inner edge of each of the field forming electrodes 126, 128, 130, 132 and 134 has a slight curvative that depends on the radial distance of the electrode from the origin, which is located along the optical axis 16 within the anode cone aperture 78. For example, the fifth field forming electrode 134, which is spaced a radial distance of 19.05 mm from the origin, has a curvature of 19.05 mm. Each of the remaining four field forming electrodes 126, 128, 130 and 132 has a curvature of 120.65 mm, 92.25 mm, 69.85 mm and 44.45 mm, respectively. This slight amount of curvature makes the field forming portion of the electrode more nearly spherical and further reduces the image distortion at the edge of the image while maintaining the spherical lens effect described herein.

What is claimed is:

1. In an electron discharge device of the type including an evacuated envelope having a longitudinal axis, said envelope enclosing a photoemissive cathode for providing electrons in response to radiation incident theren, output means spaced from said photoemissive cathode and electrostatic focusing means for focusing the electrons from said photoemissive cathode onto said output means, the improvement comprising said focusing means including a plurality of discrete, washer-like electrodes disposed between said photoemissive cathode and said output means, each of said electrodes having an electron aperture of progressively decreasing diameter wherein the electron aperture in the electrode adjacent to the photoemissive cathode being larger than the electron aperture in the electrode adjacent to the output means, said electrodes providing a substantially spherical electrostatic field lens between said photoemissive cathode and said output means.

2. The device as in claim 1, wherein said focusing means further includes a plurality of potentials applied to different ones of said discrete, washer-like electrodes to produce equipotential lines that are substantially spherically-shaped.

3. In an electron discharge device of the type including an evacuated envelope having a longitudinal axis, said envelope comprising a plurality of insulative support members of progressively decreasing diameter separated by a plurality of field forming electrodes, said envelope enclosing a photoemissive cathode for providing electrons in response to radiation incident thereon and output means spaced from said photoemissive cathode, the improvement comprising each of said field forming electrodes being disposed between adjacent insulative support members, each of said field forming electrodes having a washer-like shape with an electron aperture therethrouguh of progressively decreasing diameter wherein the electron aperture in the field forming electrode adjacent to the photoemissive cathode being larger than the electron aperture in the field forming electrode adjacent to the output means, each of said field forming electrodes extending radially inwardly toward the longitudinal axis of said envelope to shield the interior surface of each of said insulative support members from at least one of the constituents of said photoemissive cathode, said field forming electrodes providing a substantially spherical electrostatic field lens between said photoemissive cathode and said output means.

4. The device as in claim 3 further including means for applying a different potential to each of said field forming electrodes to produce equipotential lines that are substantially spherically-shaped.

5. In an intensified charge coupled image sensor including an evacuated envelope having a longitudinal axis, said envelope comprising a plurality of insulative support members of progressively decreasing diameter separated by a plurality of field forming electrodes, said envelope enclosing a photoemissive cathode disposed on an interior surface of an input window extending across the large diameter end of said envelope, said photoemissive cathode providing electrons in response to radiation incident thereon, an anode electrode having an aperture therethrough spaced from said photoemissive cathode and disposed beyond the ultimate field forming electrode, and a charge coupled device disposed across the longitudinal axis at the focal plane of said device for receiving electrons from said photoemissive cathode, the improvement comprising each of said field forming electrodes being disposed between adjacent support members, each of said field forming electrodes having an electron aperture therethrough of progressively decreasing diameter wherein the electron aperture in the field forming electrode adjacent to the photoemissive cathode being larger than the electrode aperture in the ultimate field forming electrode, each of said field forming electrodes comprising a substantially flat annular ring extending radially inwardly toward the longitudinal axis of said envelope to shield the interior surface of each of said insulative support members from at least one of the constituents of said photoemissive cathode, said field forming electrodes providing a spherical electrostatic field lens between said photoemissive cathode and said charge coupled device, and means for applying potentials to said sensor to accelerate and direct said electrons from said photoemissive cathode to said charge coupled device, said means providing a different potential to each of said field forming electrodes to produce equipotential lines that are substantially spherically-shaped.

* * * * *

UNITED STATES PATENT AND TRADEMARK OFFICE

CERTIFICATE OF CORRECTION

PATENT NO. : 4,585,935

DATED : April 29, 1986

INVENTOR(S) : Gilbert Nason Butterwick

It is certified that error appears in the above-identified patent and that said Letters Patent is hereby corrected as shown below:

Column 2, Line 11 - "bulb portion" should be --bulb sealing portion--;

Column 6, Line 11 - "92.25 mm," should be --95.25mm,--.

Signed and Sealed this

*Fifth* Day of *August 1986*

[SEAL]

*Attest:*

DONALD J. QUIGG

*Attesting Officer*

*Commissioner of Patents and Trademarks*